US006394867B1

(12) United States Patent
Bianco

(10) Patent No.: US 6,394,867 B1
(45) Date of Patent: May 28, 2002

(54) EMERGENCY SELF-INFLATING FLOTATION DEVICE

(76) Inventor: Neil Del Bianco, 47 Grandhaven Cres., Sault Ste. Marie, Ontario (CA), P6B 3Y4

( * ) Notice: Subject to any disclaimer, the term of this patent is extended or adjusted under 35 U.S.C. 154(b) by 0 days.

(21) Appl. No.: 09/782,078

(22) Filed: Feb. 14, 2001

Related U.S. Application Data

(63) Continuation-in-part of application No. 09/505,731, filed on Feb. 17, 2000, now abandoned.

(51) Int. Cl.[7] ..... B63C 9/28; B63C 9/04

(52) U.S. Cl. ..... 441/126; 114/360; 114/363; 441/41; 441/42; 441/80; 441/96

(58) Field of Search ..... 441/80, 92, 96, 441/126, 127, 40, 41, 42; 297/217.1; 114/363, 360, 68, 69

(56) References Cited

U.S. PATENT DOCUMENTS 2,052,186 A * 8/1936 Mapes
2,114,301 A * 4/1938 Harrigan
2,374,200 A * 4/1945 Heigis
2,467,037 A * 4/1949 Kajdan
2,869,150 A * 1/1959 Manhart
5,150,662 A * 9/1992 Boyd
5,682,832 A * 11/1997 Millard
6,070,546 A * 6/2000 Downey

* cited by examiner

*Primary Examiner*—Sherman Basinger
(74) *Attorney, Agent, or Firm*—Merek & Voorhees

(57) ABSTRACT

A vehicle seat comprising a seating substrate, an outer seat covering, and a housing containing an integrated self-inflating floatation device. The self-inflating flotation device includes one or more inflatable flotation bladders and an inflator that is activated to automatically inflate the one or more inflatable flotation bladders when the seat or a vehicle to which it is attached is immersed in water. The one or more inflatable flotation bladders are releasably received and secured within the housing when the bladders are deflated. The housing is received within the vehicle seat such that upon activation of the inflator the one more inflatable flotation bladders inflate and are completely released and detached from the housing and from the vehicle seat.

18 Claims, 8 Drawing Sheets

EMERGENCY SELF-INFLATING FLOTATION DEVICE

This application is a continuation in part of U.S. patent application Ser. No. 09/505,731, filed Feb. 17, 2000, now abandoned.

FIELD OF THE INVENTION

This invention relates to emergency flotation devices, and in particular self-inflating flotation devices as can be worn on an individual's back, attached to a snowmobile, motorcycle, all terrain, or other vehicle, or that can be incorporated into the seat of such a vehicle.

BACKGROUND OF THE INVENTION

Accidental drownings and serious injuries due to frost bite and exposure occur regularly in northern climates when individuals break through unsafe ice when travelling by vehicle or walking across frozen bodies of water. Others have developed a variety of different flotation suits and clothing, as well as life jackets and personal flotation devices, in order to prevent submersion should an individual break through the ice over a body of water. Such devices, while allowing an individual to remain afloat, do little, if anything, to prevent the onset of hypothermia. In the event that an individual were to break through the ice over a body of water, even if he or she were assisted in floating on the water by means of currently available flotation devices, the extreme cold would very quickly have a numbing effect followed by the onset of paralysis and hypothermia.

To provide particular assistance to individuals when riding on a vehicle that breaks through ice over a body of water, a variety of different flotation devices that may be mounted directly upon a snowmobile, motorcycle or other vehicle have been proposed. The object of such devices is to keep the vehicle afloat in the event that it becomes submerged in water. Provided such flotation devices have sufficient buoyancy, an individual riding on the vehicle will remain afloat, but only if the individual remains with the vehicle after breaking through the ice. If the individual is separated from the vehicle, he or she will be provided with no assistance in remaining afloat. Accordingly, such devices are limited in terms of their usefulness and ability to save lives and reduce injury.

SUMMARY OF THE INVENTION

The invention therefore provides an emergency self-inflating flotation device that attempts to address some of the deficiencies in currently available products.

In one of its aspects the invention provides a vehicle seat comprising a seating substrate, an outer seat covering, and a housing containing an integrated emergency self-inflating floatation device, said self-inflating flotation device comprised of one or more inflatable flotation bladders and an inflator that is activated to automatically inflate said one or more inflatable flotation bladders when said seat or a vehicle to which it is attached is immersed in water, said one or more inflatable flotation bladders releasably received and secured within said housing when said bladders are deflated, said housing received within said vehicle seat such that upon activation of said inflator said one more inflatable flotation bladders inflate and are released and detached from said housing and from said vehicle seat.

In a further aspect the invention provides a vehicle seat comprising a seating substrate, an outer seat covering, an internal cavity, and a housing received within and secured to said internal cavity, said housing containing one or more inflatable flotation bladders in a deflated state and a conduit, said conduit connected to said one or more inflatable flotation bladders and adaptable for connection to an inflator positioned within a vehicle to which said seat is to be attached such that when said seat or the vehicle to which said seat is attached become immersed in water, pressurized gas is transported through said conduit from said inflator to said inflatable flotation bladders causing said bladders to inflate and become completely released and detached from said housing, said cavity and from said vehicle seat.

In yet a further embodiment the invention provides an emergency self-inflating flotation device for use on a vehicle, said emergency self-inflating flotation device comprising; a housing secured to the vehicle and containing one or more inflatable flotation bladders in a deflated state; an inflator fixed to the vehicle; a conduit having a first end connected to said one or more inflatable flotation bladders and a second end connected to said inflator; and, a water sensing switch, said water sensing switch activating said inflator to cause said one or more inflatable flotation bladders to inflate upon immersion of the vehicle in water, upon inflation said one or more flotation bladders becoming completely released and detached from said housing, said inflator and from the vehicle such that said inflated flotation bladders float free of said housing, said inflator and the vehicle should the vehicle become immersed in water.

Further objects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF THE PREFERRED EMBODIMENT

The present invention may be embodied in a number of different forms. However, the specification and drawings that follow describe and disclose only some of the specific forms of the invention and are not intended to limit the scope of the invention as defined in the claims that follow herein.

Figure 2:
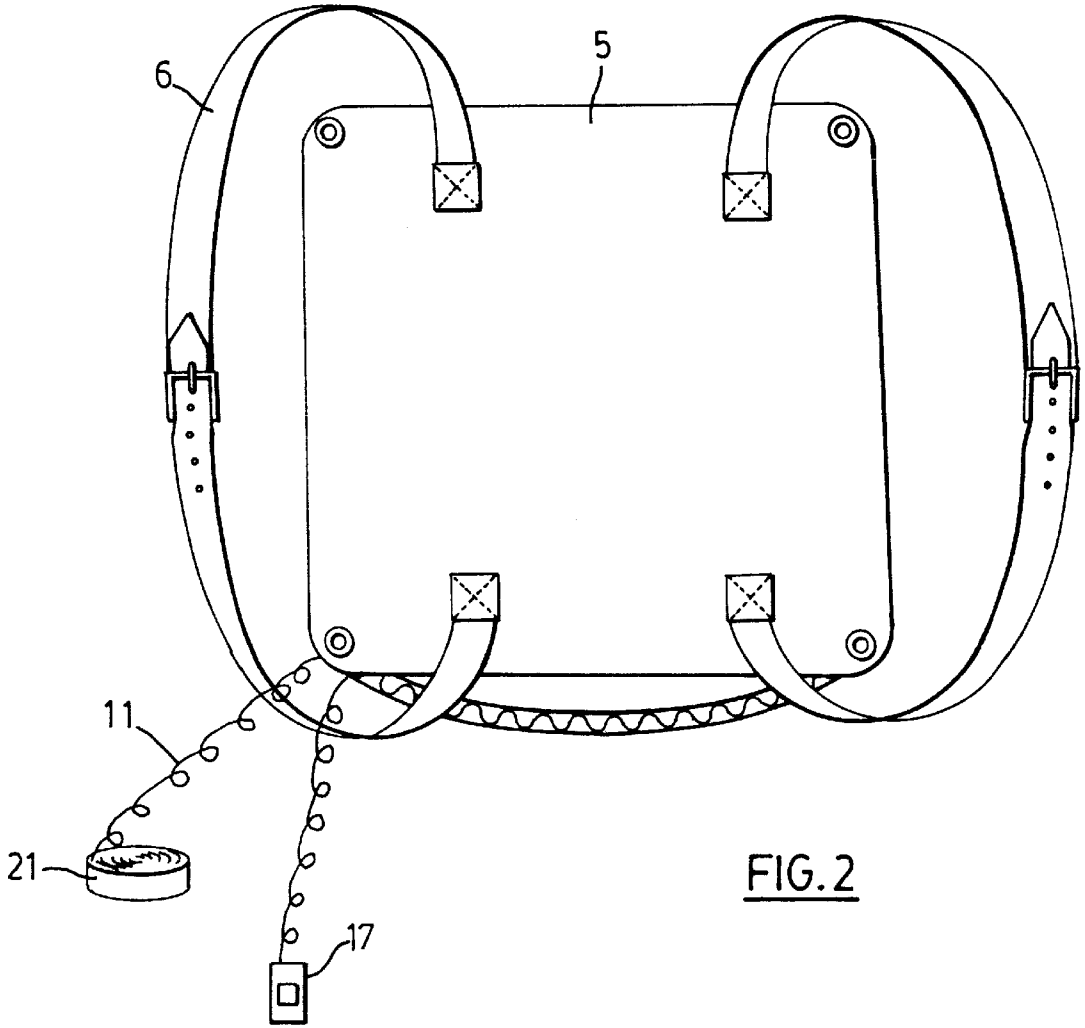
FIG. 2 is a rear view of the device shown in FIG. 1.
Figure 1:
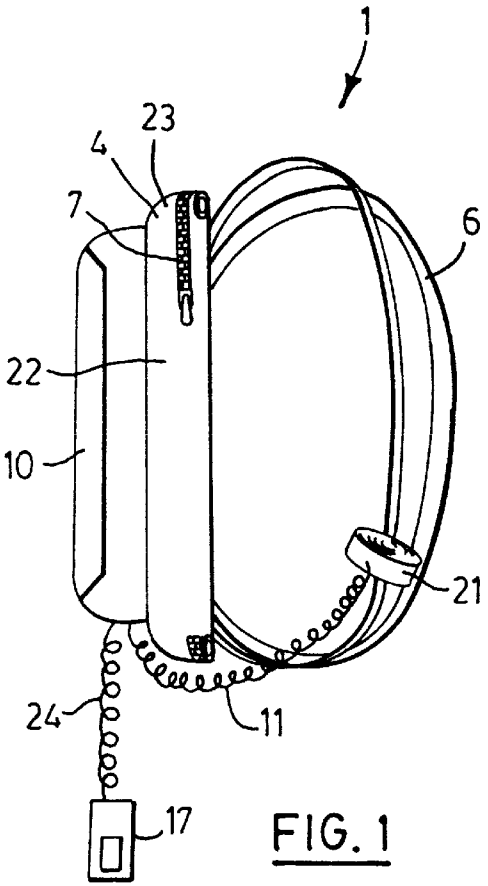
FIG. 1 is a side view of one preferred embodiment of the emergency self-inflating flotation device according to the present invention.
Figure 3:
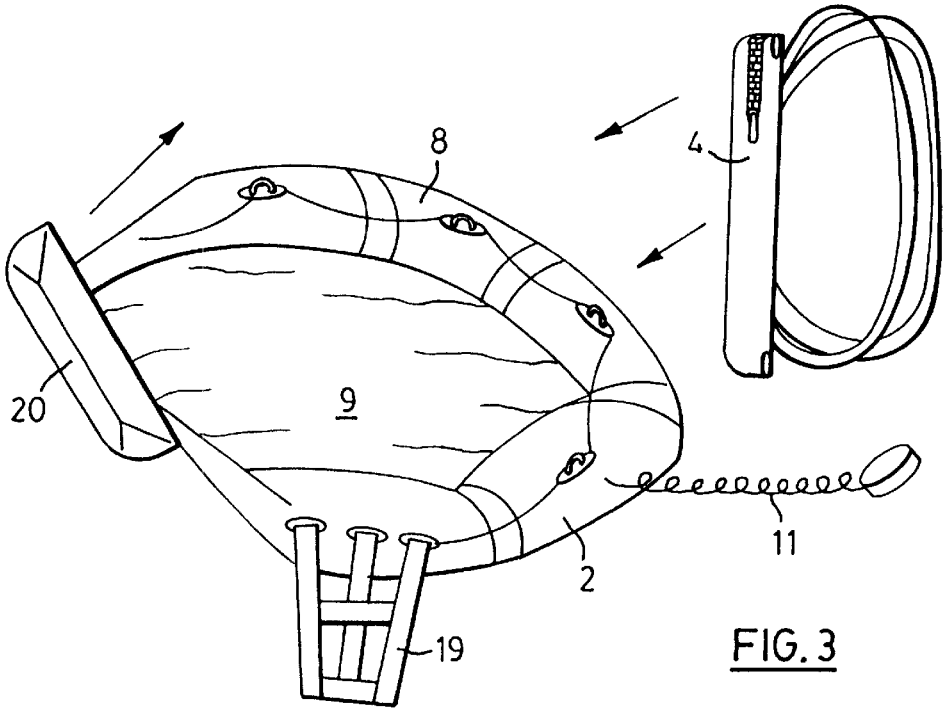
FIG. 3 is a side view of the device shown in FIG. 1 wherein the flotation bladders are in the process of being inflated and deployed.

In the attached figures the emergency self-inflating flotation device according to the present invention is noted generally by reference numeral 1. In the embodiment of the invention shown in FIGS. 1 through 3, device 1 is comprised generally of one or more inflatable flotation bladders 2 and an inflator or inflating means 3 to automatically self-inflate flotation bladders 2 when device 1 is immersed in water. There is further provided a housing or housing means 4 to contain or carry inflator 3 and flotation bladders 2 (when they are deflated). Housing 4 may be of very wide variety of different shapes and configurations while remaining within the broad scope of the invention. For example, housing 4 may be formed from rectangular frame members 5 with enclosed side panels 22. Housing 4 may also be equipped with a series of straps 6 to allow device 1 to be worn over the back and carried by the shoulders of an individual while walking across a frozen body of water. In an alternate embodiment, straps 6 could be configured so as to allow device 1 to be attached to a vehicle or other object. In yet a further embodiment, housing 4 could comprise a more traditional backpack. In still a further embodiment housing 4 could be configured to be received within a cavity formed within a vehicle seat.

Rectangular frame members 5 of housing 4 generally comprise semi-rigid members forming a stiffened frame to which the remaining aspects of device 1 may be attached and supported. If desired, rectangular frame members 5 may also be constructed with an internal pouch or pocket 23 for the storage of various different items. Access to the pouch or pocket may be provided through use of a zippered or otherwise closable opening 7.

Inflatable flotation bladders 2 should be of a sufficient size to provide adequate buoyancy to float at least one individual should the individual be immersed in water. Where desired flotation bladders 2 could be of a size to provide buoyancy to two or more individuals. For purposes of redundancy and safety, preferably multiple bladders are utilized where each bladder is capable of providing enough buoyancy to float at least one individual. In this manner, should one of the bladders become damaged the remaining bladder or bladders would still provide sufficient flotation. Inflatable flotation bladders 2 are also preferably arranged and connected to form an inflatable raft 8. Inflatable raft 8 would typically consist of the one or more inflatable flotation bladders 2 arranged in a closed geometric shape (for example circle, octagon, rectangle etc.). A sheet of pliable waterproof material, sealed to the lower surfaces of the flotation bladders, forms a floor 9 within the raft.

When flotation bladders 2 are deflated inflatable raft 8 may be folded into a relatively small bundle 10 that is releasably securable to housing 4. Included within the folded bundle may be inflator 3 and any additional or desired emergency devices, including signaling devices (such as flare guns, mirrors, whistles, air horns, etc.), matches, a flash light, a windproof emergency blanket, or similar items. Inflatable raft 8 may be folded into bundle 10 with floor 9 forming a protective outer covering to prevent damage to flotation bladders 2 and inflator 3. Alternatively, an outer sleeve or cover 20 may be used to encompass folded bundle 10 and to protect its contents. Typically cover 20 would be attached to bundle 10 and/or housing 4 through the use of any one of a variety of commonly used fasteners, including domed snaps or hook and loop fasteners.

Bundle 10 is preferably attached to housing 4 through the use of domed snaps, hook and loop fasteners or similar releasable fasteners. In this manner the folded bundle can be securely held within housing 4 while at the same time allowing the bundle to be readily separated and released from the housing upon inflation of flotation bladders 2. That is, upon activation of inflator 3 flotation bladders 2 will begin to expand and inflate, thereby causing the domed snaps, hook and loop fasteners, or other attachment means that secures folded bundle 10 to housing 4 to release, and permitting the bundle to be separated from the housing. Where an outer cover 20 is used to protect the components of bundle 10, upon inflation of the bladders and separation of bundle 10 from housing 4 the outer cover will also be released and will become separated from inflatable raft 8. It will thus be appreciated that device 1 may be carried upon the back of an individual, strapped to the exterior of a vehicle or other object, or incorporated within a vehicle seat, while freely permitting the separation of inflatable raft 8 when the device is immersed in water.

To prevent an individual who has broken through the ice from becoming separated from inflatable raft 8 device 1 may further include a tether strap 11 having a first end secured to the raft and a second end releasably securable to the individual. Preferably the second end of tether strap 11 would be releasably securable to the hand, wrist, arm or torso of an individual through use of an adjustable strap 21. In this manner an individual immersed into the water will be tethered to the raft, significantly enhancing the ability of the individual to climb out of the water and seek refuge within the inflated raft.

Figure 4:
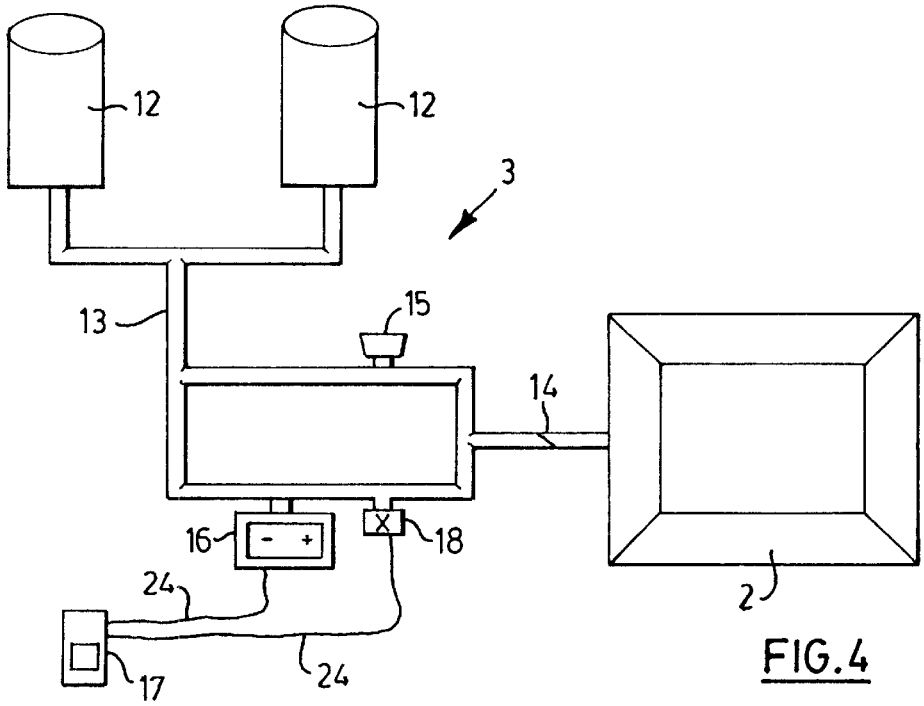
FIG. 4 is a schematic drawing of the inflation means forming part of one embodiment of the present invention.
Figure 5:
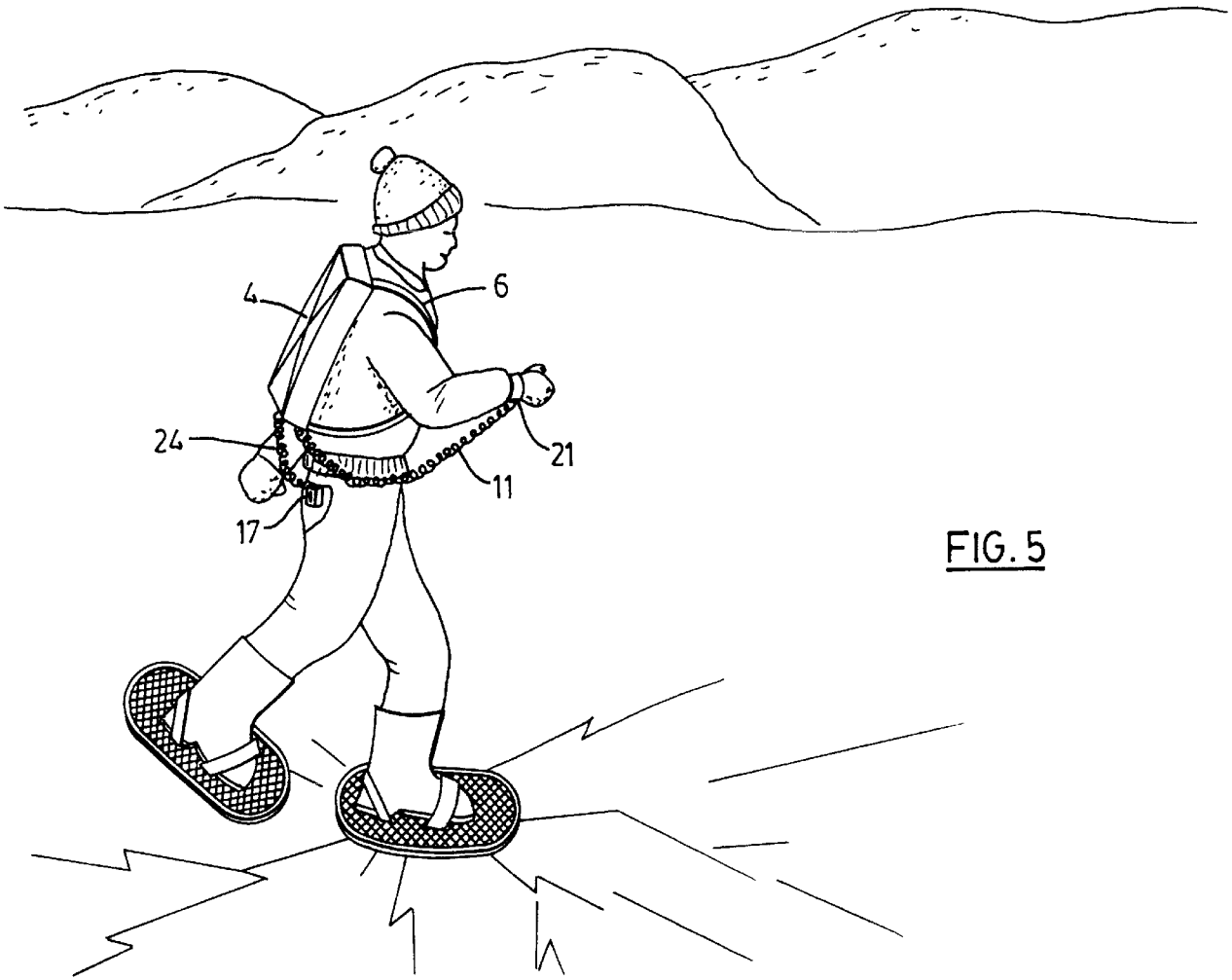
FIG. 5 is a pictorial drawing showing an individual utilizing the emergency self-inflating flotation device of FIG. 1.
Figure 6:
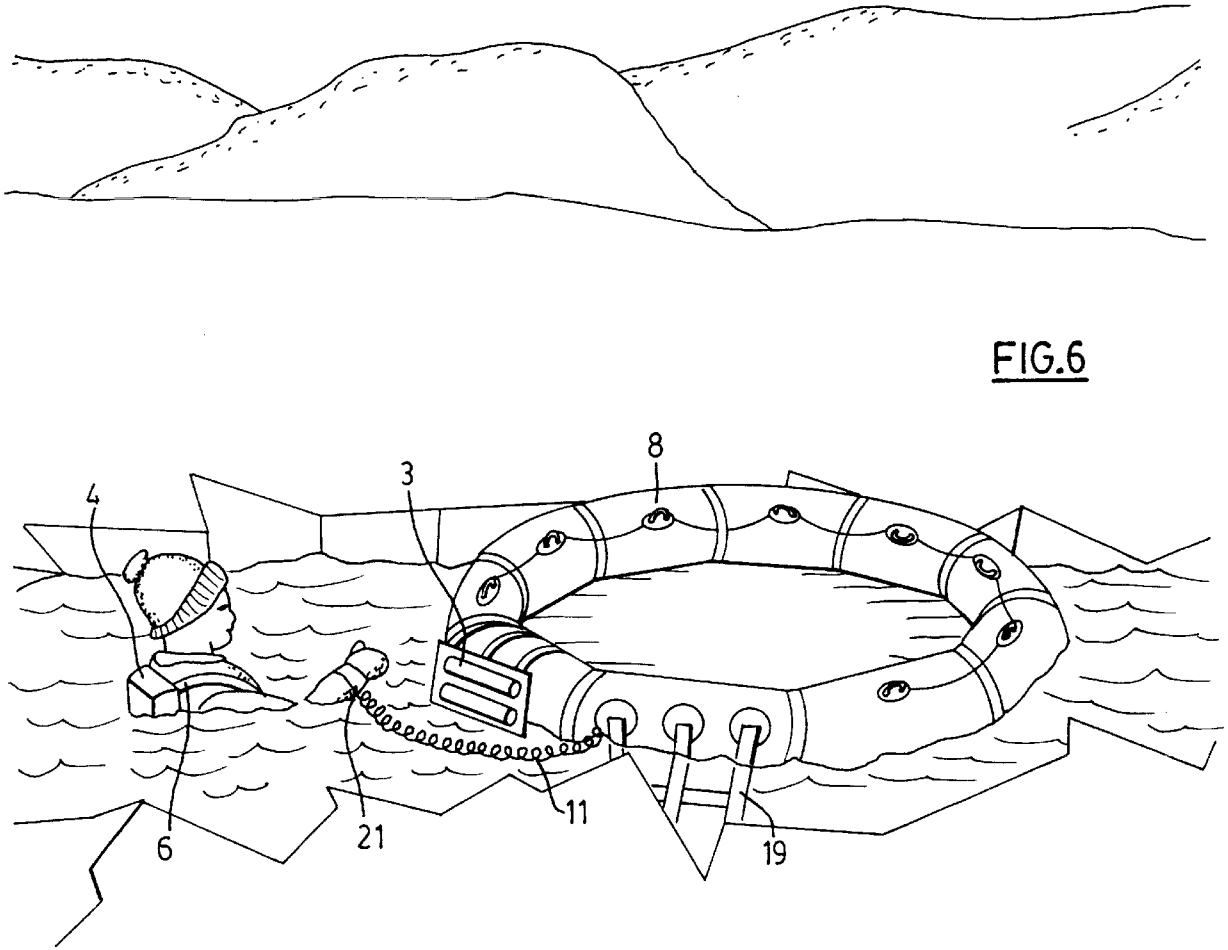
FIG. 6 is a pictoral drawing illustrating a fully deployed embodiment of the invention.
Figure 7:
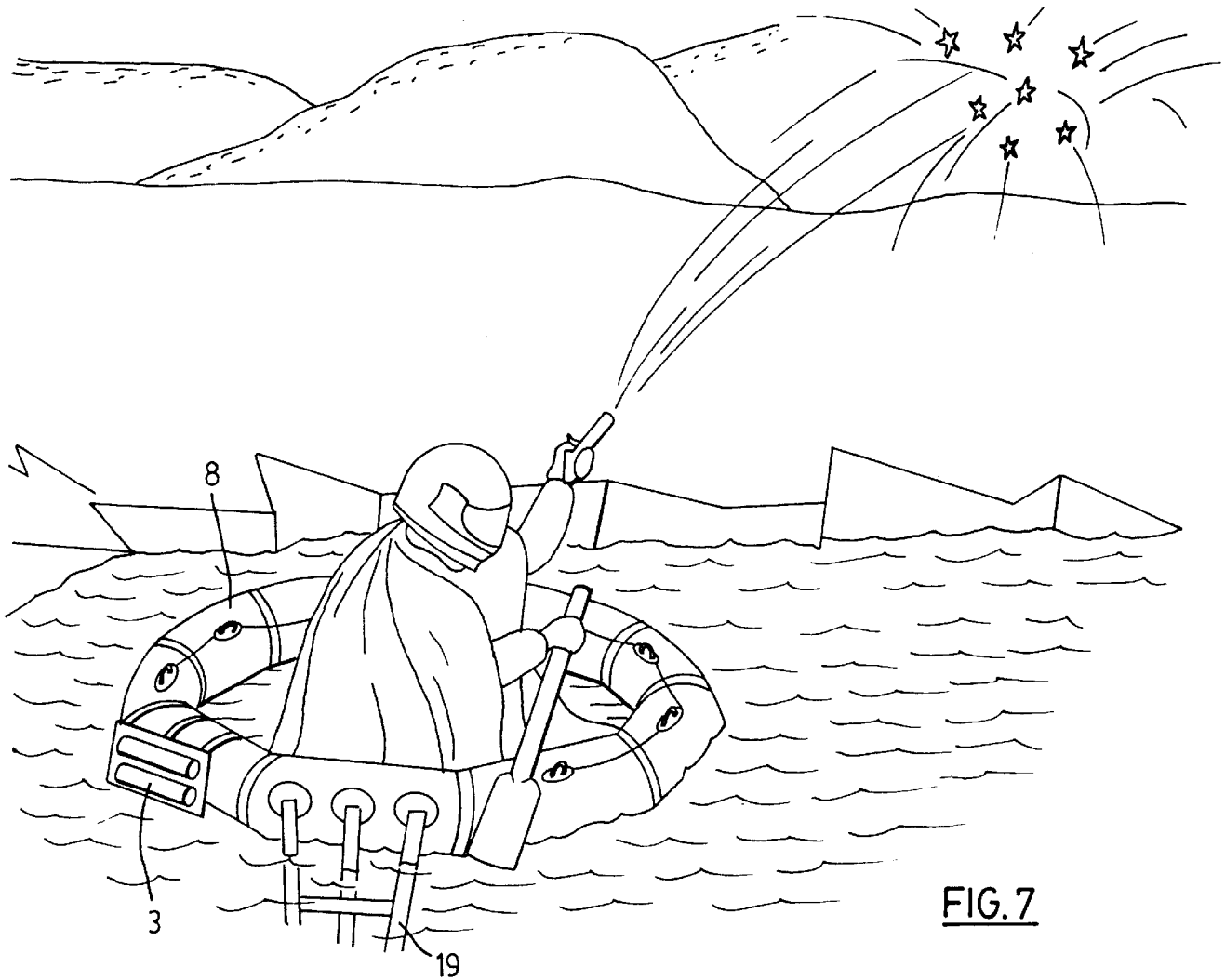
FIG. 7 is a pictorial drawing of an individual seeking refuge within the emergency self-inflating flotation device of an embodiment of the invention after having broken through a layer of ice over a body of water.
Figure 8:
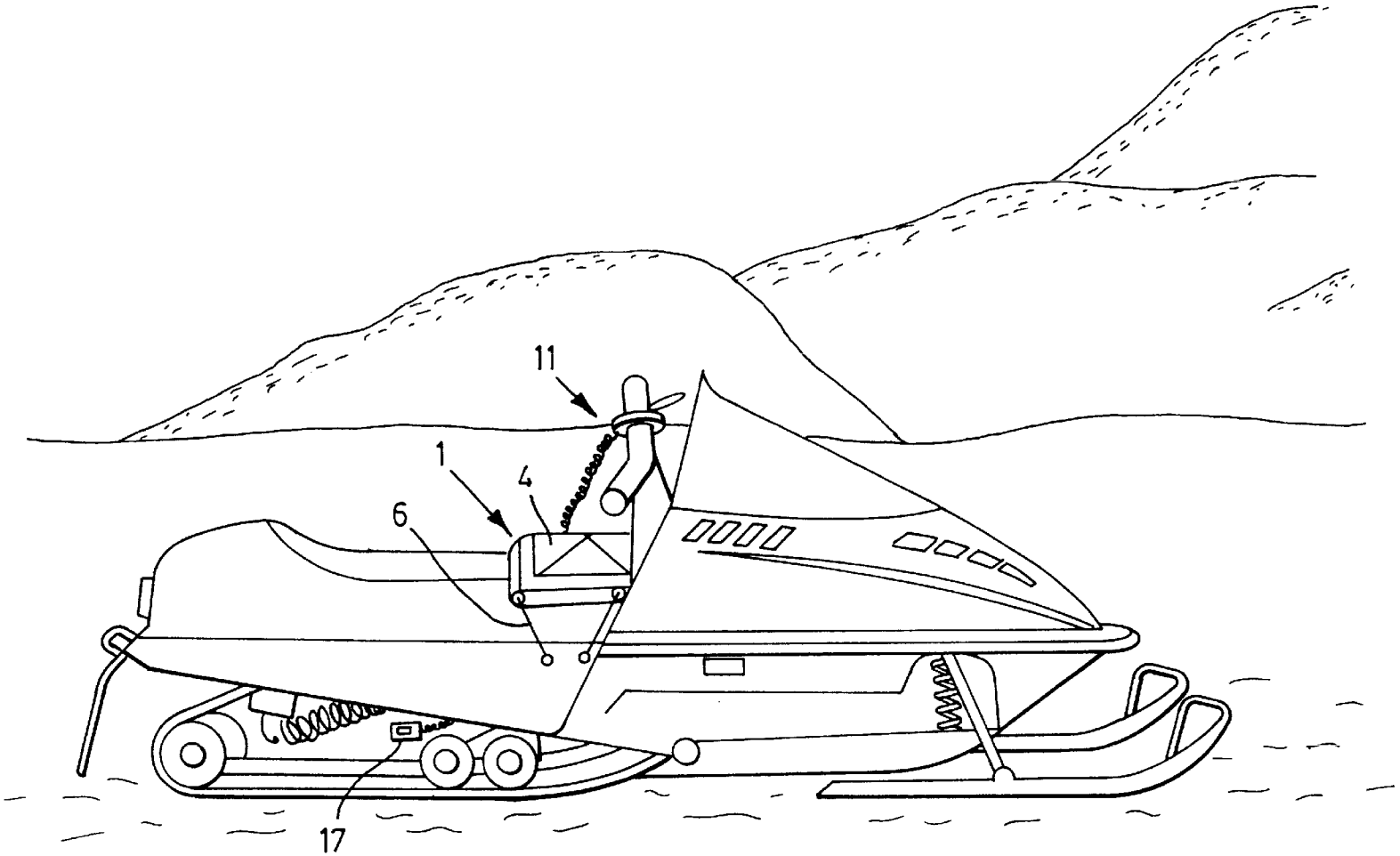
FIG. 8 is a pictorial drawing of an alternate embodiment of the invention as may be attached to a snowmobile.

Referring now to FIG. 4, there is shown a general schematic drawing of inflator 3. It will, of course, be appreciated that inflator 3 may comprise a wide variety of different automatic or self-inflating mechanisms. In one of the preferred embodiments of the present invention inflator 3 includes a vessel 12 of pressurized gas. Depending upon the volume of gas required to inflate the flotation bladders, and size constraints when forming folded bundle 10, one, two or more pressurized vessels may be required. In most instances it is expected that the pressurized gas would be an inert, common, and relatively inexpensive gas, such as carbon dioxide. Vessels 12 are connected to flotation bladders 2 by means of sealed piping, tubing or conduit 13 that is capable of delivering the pressurized gas to bladders 2, causing the bladders to inflate. A one-way check valve 14 is used to prevent the pressurized gas from escaping the bladders after they have been inflated.

Activation of inflator 3 may be accomplished generally in one of two primary ways. First, inflator 3 may include a manual activation means 15 that permits the pressurized gas within vessels 12 to flow through piping 13 into flotation bladders 2. Manual activation means 15 effectively operates as a normally closed manual valve that releases pressurized gas from vessels 12 to bladders 2 when opened. Most commonly manual activation means 15 would comprise a manual valve activated by pulling on a rope or cord. Secondly, inflator 3 may include an automatic self-inflating mechanism to cause automatic inflation of bladders 2 upon immersion of device 1 in water. The self-inflating mechanism would typically include a battery or power source 16 that is connected to a water sensing switch 17. Water sensing switch 17 would then in turn be electrically connected, by means of wires 24, to a normally closed automatic inflating valve 18 positioned in piping 13 between vessels 12 and bladders 2. When immersed in water, water sensing switch 17 forms an electrical circuit between battery 16 and valve 18 causing the valve to open and allowing pressurized gas to flow from vessels 12 to bladders 2. Water sensing switch 17 may be physically mounted upon the exterior of folded bundle 10 or, alternatively, may be remotely mounted upon a portion of a vehicle or other object to which device 1 may be attached.

In yet a further embodiment, value 18 may include a component that chemically reacts with water such that when immersed in water the dissolution or reaction of the component causes the valve to open to deliver pressurized gas to bladders 2. Values that operate in this manner have the advantage of not requiring any electrical connections and not requiring a source of electricity to function.

It will therefore be appreciated from an understanding of the present invention that emergency self-inflating flotation device 1 provides for the deployment of an inflatable raft onto which an individual can climb to seek shelter when falling through ice over a frozen body of water. The components of the inflatable raft and the inflation system may be folded into a relatively small and compact bundle that is releasably securable to a housing or frame that may be carried upon the back of an individual, or strapped to a vehicle or other object. Alternatively, and as is discussed in more detail below, the raft (and if desired the inflation system) could be incorporated within the seat of a vehicle to allow for deployment should the vehicle become immersed in water.

Inflation of the raft may be accomplished through use of a manual activation switch, or automatically upon immersion. In either case, through manual or automatic activation pressurized gas is released from containment vessels into one or more flotation bladders in order to inflate the raft. During inflation the folded raft and its component parts readily detach from the housing or the vehicle and the individual is maintained in close proximity to the raft by way of a tether strap. The raft and its floor are preferably comprised of a relatively light weight, tough and abrasion resistant material of a bright colour so as to be easily recognized by search and rescue personnel. A collapsible entry ladder 19 may also be attached to the side of inflatable raft 8 to allow an individual to more easily climb into the raft after deployment.

In FIGS. 9 through 13 there is shown an embodiment of the invention that comprises a vehicle seat 25 formed from a seating substrate 26 and an outer seat covering 27. In these Figures seat 25 is shown as a snowmobile seat attached to snowmobile 30. However, it will be appreciated that the seat could also be in the form of a seat for an all terrain or other vehicle. Typically seating substrate 26 will be comprised of a foam or other commonly used cushioning material with outer seat covering formed from leather, plastic, vinyl, woven textile or other similar material. Vehicle seat 25 is preferably formed with an internal cavity 28 (shown in dotted outline in FIG. 10) to receive housing 4 with one or more of inflatable flotation bladders 2 secured therein. Cavity 28 would generally be located in either the forward most or rearward most portions of vehicle seat 25 so as to be less likely to be positioned directly beneath an individual sitting upon the seat.

In one preferred embodiment the portion of outer seat covering 27 immediately above internal cavity 28 includes an opening 29 to permit the flotation bladders to escape cavity 27 and housing 4 upon inflation. To provide a means to prevent dirt, water and debris from entering cavity 28, and to protect its contents, opening 29 is preferably enclosed by a pair of flaps 31 and 32 that have an open and a closed configuration. In their closed configuration flaps 31 and 32 conceal housing 4 and present a barrier to keep out unwanted elements. To maintain the flaps in their normally closed configuration, their ends may be formed such that they are slightly overlapping and may be fitted with hook and loop fasteners, dome fasteners, or other suitable releasable fastening devices (identified generally as 33 in FIG. 13). In an alternate embodiment, housing 4 may be concealed through with a rectangular sheet of material that may be releasably secured about cavity 28 through the use of releasable fasteners.

It will be appreciated that upon the inflation of flotation bladders 2 their expansion causes the hook and loop fasteners, domes or other fastening mechanisms holding flaps 31 and 32 in their closed configuration (or holding a covering sheet of material in an alternate embodiment) to be released opening up a passageway through outer seat covering 27 to permit the flotation bladders to escape internal cavity 28 and be released from both housing 4 and seat 25.

Figure 9:
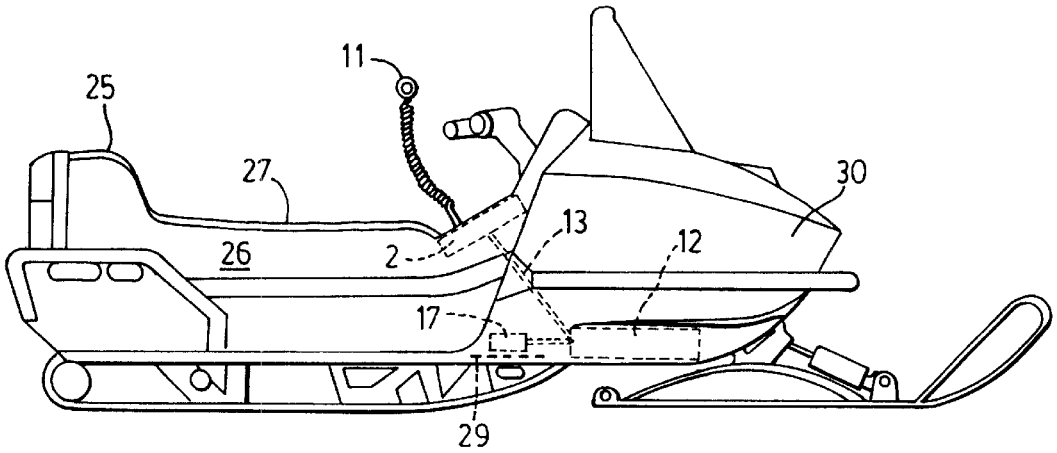
FIG. 9 is a pictorial drawing of a snowmobile incorporating a further alternate embodiment of the invention.
Figure 10:
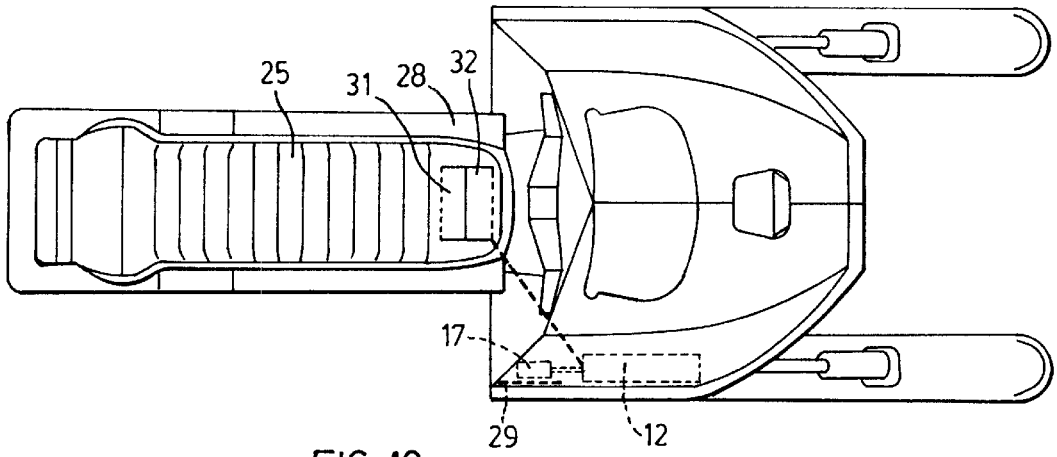
FIG. 10 is a top plan view of the snowmobile of FIG. 9.

Inflator 3 may be contained within housing 4 and may accompany the flotation bladders when they are inflated and deployed from the housing. Alternatively, inflator 3 may be secured to housing 4 and/or to seat 25 and may remain in place with the housing and seat after deployment of the flotation bladders. In a further alternate embodiment inflator 3 may be housed within a separate portion of the vehicle to which the seat is attached. For example, by way of illustration FIG. 9 shows an embodiment of the invention where the inflator is positioned within the engine compartment of snowmobile 30. In this embodiment conduit 13 runs from the remote inflator and connects to inflatable flotation bladders 2 held within housing 4 in seat 25. Automatic inflating valve 18 may also be located either within the vehicle seat or may be positioned at a remote location (see FIG. 9) on the vehicle to which the seat is attached. Where valve 18 is also positioned within the vehicle engine compartment, there may be included a series of water inlet holes within the side of the engine compartment cowling to allow water to quickly access valve 18 upon immersion of the vehicle.

Figure 11:
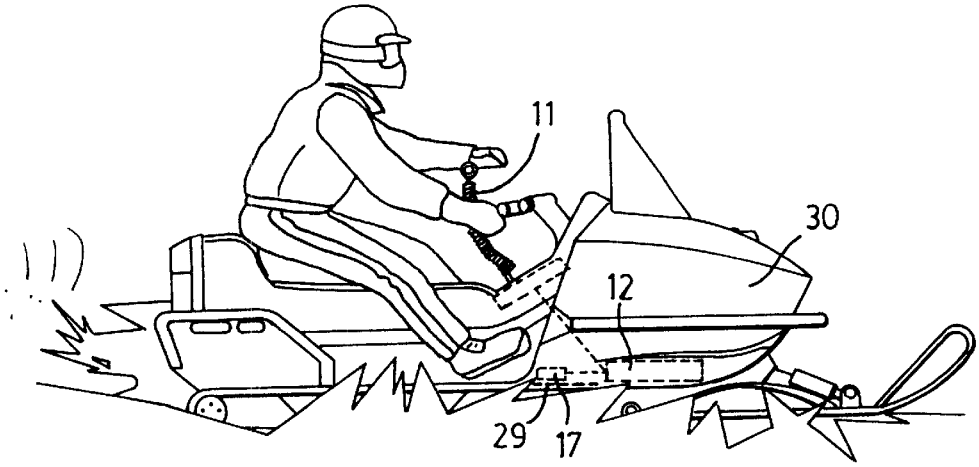
FIG. 11 is a pictoral view of a snowmobile incorporating an embodiment of the invention wherein the snowmobile is in the process of breaking through a layer of ice over a body of water.
Figure 12:
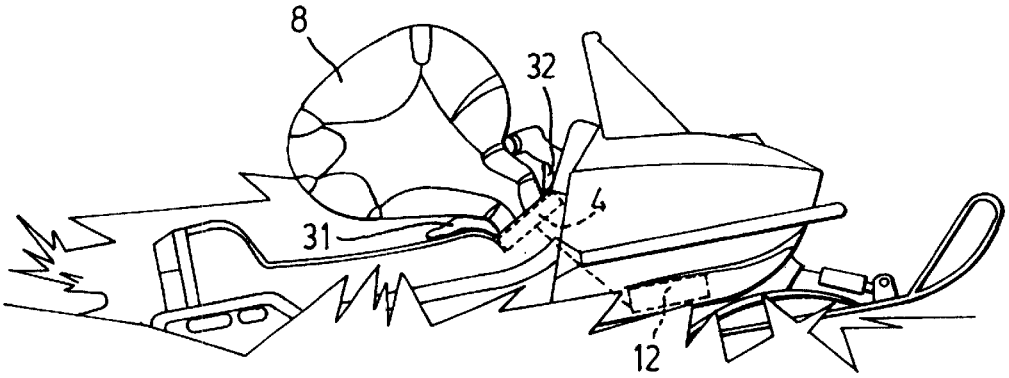
FIG. 12 is a pictorial view of the snowmobile of FIG. 11 wherein the self-inflating flotation device of the present invention is in the process of being deployed; and, FIG. 13 is a cross-sectional view taken longitudinally through a snowmobile seat having integrated into it a number of the components of the self-inflating flotation device of the present invention.
Figure 13:
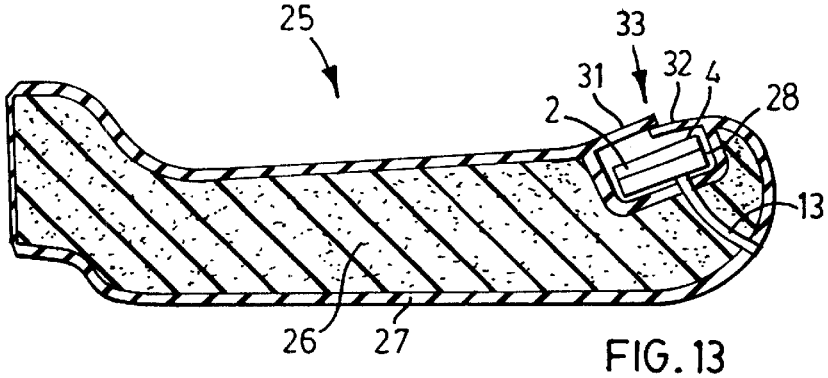

As described above, the present invention may also include a tether strap 11 having one end secured to inflatable flotation bladders 2 and the other end releaseably securable to the hand, wrist, arm or torso of an individual through an adjustable strap 21 (see FIGS. 9 and 11). An individual operating a vehicle over ice or near a body of water will thus be tethered to inflatable flotation bladders 2 upon their deployment. The individual will therefore be pulled free from the vehicle in the event that the vehicle should become immersed, even where the individual may be unconscious or otherwise incapacitated. Tether 11 will also ensure that the individual is maintained a close distance from the inflated bladders even though the momentum of a vehicle that enters a body of water may tend to carry it a considerable distance.

It is to be understood that what has been described are the preferred embodiments of the invention and that it may be possible to make variations to these embodiments while staying within the broad scope of the invention. Some of these variations have been discussed while others will be readily apparent to those skilled in the art.

I claim:

1. A vehicle seat comprising a seating substrate, an outer seat covering, and a housing containing an emergency integrated self-inflating floatation device, said self-inflating flotation device comprised of one or more inflatable flotation bladders and an inflator that is activated to automatically inflate said one or more inflatable flotation bladders when said seat or a vehicle to which it is attached is immersed in water, said one or more inflatable flotation bladders releasably received and secured within said housing when said bladders are deflated, said housing received within said vehicle seat such that upon activation of said inflator said one more inflatable flotation bladders inflate and are released and detached from said housing and from said vehicle seat.

2. The device as claimed in claim 1 wherein said one or more inflatable flotation bladders form an inflatable raft.

3. The device as claimed in claim 2 wherein said inflatable raft includes a collapsible entry ladder.

4. The device as claimed in claim 2 wherein said inflatable raft includes an emergency signaling device.

5. The device as claimed in claim 1 wherein said seat includes an internal cavity, said cavity receiving said housing therein.

6. The device as claimed in claim 5 wherein said outer seat covering has an opening therethrough, said opening generally aligned with said cavity in said seat and having a closed configuration and an open configuration, when said opening is in said closed configuration said outer seat covering concealing said housing and said one or more inflatable flotation bladders received therein, when in said open configuration said opening revealing said housing and said one or more flotation bladders and allowing the release of said flotation bladders from said housing and said seat upon inflation of said flotation bladders.

7. The device as claimed in claim 6 including a pair of flaps formed in said outer seat covering, said flaps having an open and a closed position, when in said closed position said flaps enclosing said opening through said outer seat covering and concealing said housing, when in said open position said flaps revealing said housing.

8. The device as claimed in claim 7 wherein inflation of said inflatable flotation bladders caused said flaps to be moved from said closed to said open position.

9. The device as claimed in claim 1 including a tether strap having a first end secured to at least one of said one or more inflatable flotation bladders and a second end releasably securable to an individual, said tether strap maintaining said inflatable flotation bladder in close proximity to the individual upon inflation of said bladder and separation from said housing and said seat.

10. The device as claimed in claim 1 wherein said inflator includes a vessel of pressurized gas, an automatic inflating valve, and a conduit to deliver pressurized gas from said vessel to said one or more inflatable flotation bladders, said automatic inflating valve having an open and a closed position, when in said closed position said valve preventing the flow of pressurized gas through said conduit from said vessel to said one or more inflatable flotation bladders, upon immersion of said seat or a vehicle to which it is attached in water said automatic inflating valve activated to move from said closed position to said open position thereby permitting the flow of pressurized gas from said vessel to said one or more inflatable flotation bladders.

11. The device as claimed in claim 10 wherein said conduit connecting said one or more inflatable flotation bladders to said vessel of pressurized gas includes a one-way check valve to prevent the escape of pressurized gas from said bladders following inflation.

12. The device as claimed in claim 11 including a manual activation switch to permit said inflator to inflate said one or more inflatable flotation bladders irrespective of the operation of said automatic inflating valve.

13. The device as claimed in claim 1 wherein said one or more inflatable flotation bladders are securable to said housing by way of hook and loop fasteners.

14. The device as claimed in claim 1 wherein said seat is a seat for a snowmobile, motorcycle or all terrain vehicle.

15. A vehicle seat comprising a seating substrate, an outer seat covering, an internal cavity, and a housing received within and secured to said internal cavity, said housing containing one or more inflatable flotation bladders in a deflated state and a conduit, said conduit connected to said one or more inflatable flotation bladders and adaptable for connection to an inflator positioned within a vehicle to which said seat is to be attached such that when said seat or the vehicle to which said seat is attached become immersed in water, pressurized gas is transported through said conduit from said inflator to said inflatable flotation bladders causing said bladders to inflate and become completely released and detached from said housing, said cavity and from said vehicle seat.

16. The device as claimed in claim 15 wherein said one or more inflatable flotation bladders form an inflatable raft when inflated.

17. The device as claimed in claim 16 wherein said seat is a snowmobile seat and said inflator is positioned within the engine compartment of said snowmobile.

18. An emergency self-inflating flotation device for use on a snowmobile, said emergency self-inflating flotation device comprising;

(i) a housing secured to the snowmobile and containing one or more inflatable flotation bladders in a deflated state, said one or more inflatable flotation bladders forming an inflatable raft;

(ii) an inflator fixed to the snowmobile;

(iii) a conduit having a first end connected to said one or more inflatable flotation bladders and a second end connected to said inflator; and, (iv) a water sensing switch positioned within the snowmobile's engine compartment, when a predetermined level of water enters the snowmobile's engine compartment said water sensing switch activating said inflator to cause said one or more inflatable flotation bladders to inflate upon immersion of the snowmobile in water, upon inflation said one or more flotation bladders becoming completely released and detached from said housing, said inflator and from the snowmobile such that said inflated flotation bladders float free of said housing, said inflator and the snowmobile should the snowmobile become immersed in water.

* * * * *